US006457262B1

(12) United States Patent
Swigart

(10) Patent No.: US 6,457,262 B1
(45) **Date of Patent: *Oct. 1, 2002**

(54) ARTICLE OF FOOTWEAR WITH A MOTION CONTROL DEVICE

(75) Inventor: John Swigart, Portland, OR (US)

(73) Assignee: Nike, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/526,862

(22) Filed: Mar. 16, 2000

(51) Int. Cl.[7] ..... A43B 13/20; A61F 5/14
(52) U.S. Cl. ..... 36/29; 36/144; 36/35 B
(58) Field of Search ..... 36/3 R, 3 B, 28, 36/29, 35 B, 142, 143, 144

(56) References Cited

U.S. PATENT DOCUMENTS

| | | | |
|---|---|---|---|
| 900,867 | A | 10/1908 | Miller |
| 1,069,001 | A | 7/1913 | Guy |
| 1,240,153 | A | 9/1917 | Olsen |

(List continued on next page.)

FOREIGN PATENT DOCUMENTS

| | | | |
|---|---|---|---|
| AT | 181938 | | 2/1906 |
| AT | 200963 | | 12/1958 |
| CA | 727582 | | 2/1966 |
| DE | 32 34 086 | | 9/1982 |
| DE | G92 01 758.4 | | 12/1992 |
| EP | 0 094 868 | | 5/1983 |
| EP | 0 215 974 | A1 | 9/1985 |
| EP | 0 605 485 | B1 | 9/1992 |
| EP | 0 780 064 | A | 6/1997 |
| FR | 1195549 | | 11/1959 |
| FR | 1406610 | | 11/1965 |
| FR | 2144464 | | 1/1973 |
| FR | 2404413 | | 4/1979 |
| FR | 2407008 | | 5/1979 |
| FR | 2483321 | | 4/1981 |
| FR | 2614510 | | 4/1987 |
| FR | 2.639537 | | 11/1988 |
| GB | 14955 | | of 1893 |
| GB | 7441 | | of 1906 |
| GB | 233387 | | 1/1924 |
| GB | 978654 | | 12/1964 |
| GB | 1128764 | | 10/1968 |
| JP | 6-181802 | | 7/1994 |
| JP | 266718 | | 9/2000 |
| TW | App. 75100322 | | 1/1975 |
| TW | Util Model 54221 | | 6/1978 |
| WO | WO89/10074 | | 11/1989 |
| WO | WO90/10396 | | 9/1990 |
| WO | WO91/11928 | | 8/1991 |
| WO | WO91/11931 | | 8/1991 |
| WO | WO92/08384 | | 5/1992 |
| WO | WO95/20332 | | 8/1995 |
| WO | WO 98/09546 | | 3/1998 |

OTHER PUBLICATIONS

Sports Research Review, NIKE, Inc., Jan./Feb. 1990.
Brooks Running Catalog, Fall 1991.
Vernay Labortories website download entitled "Check Valves: Engineering Fluid Control".
Vernay Laboratories website download entitled "Vernay® Duckbill Check Valves".

*Primary Examiner*—M. D. Patterson
(74) *Attorney, Agent, or Firm*—Banner & Witcoff, LTD

(57) ABSTRACT

An article of footwear with a bladder system providing cushioning and dynamic motion control in a multi-bladder system. The bladder system gives the needed amount of motion control by stiffening a portion of the footwear in response to the individual user's side-to-side motion. When used in the heel, the bladder system takes into consideration a center-of-pressure pathway of the foot to increase medial stiffness in response to lateral-to-medial rotation of the foot, so the more a user pronates, the stiffer the medial portion of the footwear is made. The bladder system provides comfort and control without the extra weight and bulk of prior art support structures. The bladder system dynamically changes the stiffness of a portion of the footwear when pressure is applied thereto, and returns to equilibrium when the pressure is removed.

19 Claims, 4 Drawing Sheets

U.S. PATENT DOCUMENTS

| | | | | | |
|---|---|---|---|---|---|
| 1,304,915 | A | | 5/1919 | Spinney | |
| 1,323,610 | A | | 12/1919 | Price | |
| 1,514,468 | A | | 11/1924 | Schopf | |
| 1,584,034 | A | | 5/1926 | Klotz | |
| 1,625,582 | A | | 4/1927 | Anderson | |
| 1,625,810 | A | | 4/1927 | Krichbaum | |
| 1,869,257 | A | | 7/1932 | Hitzler | |
| 1,916,483 | A | | 7/1933 | Krichbaum | |
| 1,970,803 | A | | 8/1934 | Johnson | |
| 2,004,906 | A | | 6/1935 | Simister | |
| 2,080,469 | A | | 5/1937 | Gilbert | |
| 2,086,389 | A | | 7/1937 | Pearson | |
| 2,269,342 | A | | 1/1942 | Johnson | |
| 2,365,807 | A | | 12/1944 | Dialynas | |
| 2,488,382 | A | | 11/1949 | Davis | |
| 2,546,827 | A | | 3/1951 | Lavinthal | |
| 2,600,239 | A | | 6/1952 | Gilbert | |
| 2,645,865 | A | | 7/1953 | Town | |
| 2,677,906 | A | | 5/1954 | Reed | |
| 2,703,770 | A | | 3/1955 | Melzer | |
| 2,748,401 | A | | 6/1956 | Winstead | |
| 2,762,134 | A | | 9/1956 | Town | |
| 3,030,640 | A | | 4/1962 | Gosman | |
| 3,048,514 | A | | 8/1962 | Bentele et al. | |
| 3,120,712 | A | | 2/1964 | Menken | |
| 3,121,430 | A | | 2/1964 | O'Reilly | |
| 3,204,678 | A | | 9/1965 | Worcester | |
| 3,251,076 | A | | 5/1966 | Burke | |
| 3,284,264 | A | | 11/1966 | O'Rourke | |
| 3,335,045 | A | | 8/1967 | Post | |
| 3,366,525 | A | | 1/1968 | Jackson | |
| 3,469,576 | A | | 9/1969 | Smith et al. | |
| 3,568,227 | A | | 3/1971 | Dunham | |
| 3,589,037 | A | | 6/1971 | Gallagher | |
| 3,608,215 | A | | 9/1971 | Fukuoka | |
| 3,685,176 | A | | 8/1972 | Rudy | |
| 3,758,964 | A | | 9/1973 | Nishimura | |
| 3,765,422 | A | | 10/1973 | Smith | |
| 3,795,994 | A | * | 3/1974 | Ava | |
| 4,017,931 | A | | 4/1977 | Golden | |
| 4,054,960 | A | | 10/1977 | Pettit et al. | |
| 4,115,934 | A | | 9/1978 | Hall | |
| 4,129,951 | A | | 12/1978 | Petrosky | |
| 4,167,795 | A | | 9/1979 | Lambert, Jr. | |
| 4,183,156 | A | * | 1/1980 | Rudy | |
| 4,187,620 | A | | 2/1980 | Seiner | |
| 4,217,705 | A | | 8/1980 | Donzis | |
| 4,219,945 | A | * | 9/1980 | Rudy | |
| 4,271,606 | A | | 6/1981 | Rudy | |
| 4,287,250 | A | | 9/1981 | Rudy | |
| 4,292,702 | A | | 10/1981 | Phillips | |
| 4,297,797 | A | | 11/1981 | Meyers | |
| 4,305,212 | A | | 12/1981 | Coomer | |
| 4,328,599 | A | | 5/1982 | Mollura | |
| 4,358,902 | A | * | 11/1982 | Cole et al. | 36/29 |
| 4,431,003 | A | | 2/1984 | Sztancsik | |
| 4,446,634 | A | * | 5/1984 | Johnson et al. | 36/29 |
| 4,458,430 | A | | 7/1984 | Peterson | |
| 4,483,030 | A | | 11/1984 | Plick et al. | |
| 4,486,964 | A | | 12/1984 | Rudy | |
| 4,506,460 | A | | 3/1985 | Rudy | |
| 4,547,919 | A | | 10/1985 | Wang | |
| 4,662,087 | A | | 5/1987 | Beuch | |
| 4,670,995 | A | | 6/1987 | Huang | |
| 4,686,130 | A | | 8/1987 | Kon | |
| 4,722,131 | A | | 2/1988 | Huang | |
| 4,744,157 | A | | 5/1988 | Dubner | |
| 4,763,426 | A | * | 8/1988 | Polus et al. | 36/29 |
| 4,779,359 | A | | 10/1988 | Famolare, Jr. | |
| 4,782,602 | A | | 11/1988 | Lakic | |
| 4,803,029 | A | | 2/1989 | Iversen et al. | |
| 4,817,304 | A | | 4/1989 | Parker et al. | |
| 4,823,482 | A | | 4/1989 | Lakic | |
| 4,845,338 | A | | 7/1989 | Lakic | |
| 4,845,861 | A | | 7/1989 | Moumgdgian | |
| 4,874,640 | A | | 10/1989 | Donzis | |
| 4,891,855 | A | | 1/1990 | Cheng-Chung | |
| 4,906,502 | A | | 3/1990 | Rudy | |
| 4,912,861 | A | | 4/1990 | Huang | |
| 4,936,029 | A | | 6/1990 | Rudy | |
| 4,965,899 | A | | 10/1990 | Sekido et al. | |
| 4,991,317 | A | | 2/1991 | Lakic | |
| 4,999,931 | A | | 3/1991 | Vermeulen | |
| 4,999,932 | A | | 3/1991 | Grim | |
| 5,022,109 | A | | 6/1991 | Pekar | |
| 5,025,575 | A | | 6/1991 | Lakic | |
| 5,042,176 | A | | 8/1991 | Rudy | |
| 5,044,030 | A | | 9/1991 | Balaton | |
| 5,046,267 | A | | 9/1991 | Kilgore et al. | |
| 5,083,361 | A | | 1/1992 | Rudy | |
| 5,104,477 | A | | 4/1992 | Williams et al. | |
| 5,155,927 | A | | 10/1992 | Bates et al. | |
| 5,158,767 | A | | 10/1992 | Cohen et al. | |
| 5,179,792 | A | | 1/1993 | Brantingham | |
| 5,193,246 | A | | 3/1993 | Huang | |
| 5,199,191 | A | | 4/1993 | Moumdjian | |
| 5,224,277 | A | | 7/1993 | Sang Do | |
| 5,224,278 | A | | 7/1993 | Jeon | |
| 5,228,156 | A | | 7/1993 | Wang | |
| 5,235,715 | A | | 8/1993 | Donzis | |
| 5,238,231 | A | | 8/1993 | Huang | |
| 5,245,766 | A | | 9/1993 | Warren | |
| 5,253,435 | A | | 10/1993 | Auger et al. | |
| 5,257,470 | A | | 11/1993 | Auger et al. | |
| 5,297,349 | A | | 3/1994 | Kilgore | |
| 5,335,382 | A | | 8/1994 | Huang | |
| 5,337,492 | A | | 8/1994 | Anderie et al. | |
| 5,353,523 | A | | 10/1994 | Kilgore et al. | |
| 5,355,552 | A | | 10/1994 | Huang | |
| 5,367,791 | A | | 11/1994 | Gross et al. | |
| 5,406,719 | A | * | 4/1995 | Potter | |
| 5,425,184 | A | | 6/1995 | Lyden et al. | |
| 5,524,364 | A | * | 6/1996 | Cole et al. | 36/29 |
| 5,543,194 | A | | 8/1996 | Rudy | |
| 5,558,395 | A | | 9/1996 | Huang | |
| 5,572,804 | A | | 11/1996 | Skaja et al. | |
| 5,595,004 | A | | 1/1997 | Lyden et al. | |
| 5,625,964 | A | * | 5/1997 | Lyden et al. | 36/29 |
| 5,669,161 | A | | 9/1997 | Huang | |
| 5,673,498 | A | * | 10/1997 | Amir et al. | 36/29 |
| 5,686,167 | A | | 11/1997 | Rudy | |
| 5,704,137 | A | * | 1/1998 | Dean et al. | 36/29 |
| 5,713,141 | A | | 2/1998 | Mitchell et al. | |
| 5,741,568 | A | | 4/1998 | Rudy | |
| 5,753,061 | A | | 5/1998 | Rudy | |
| 5,755,001 | A | | 5/1998 | Potter et al. | |
| 5,771,606 | A | | 6/1998 | Lithcfield et al. | |
| 5,802,739 | A | | 9/1998 | Potter et al. | |
| 5,813,142 | A | | 9/1998 | Demon | |
| 5,826,349 | A | * | 10/1998 | Goss | 36/29 |
| 5,830,553 | A | | 11/1998 | Huang | |
| 5,832,630 | A | | 11/1998 | Potter | |
| 5,846,063 | A | | 12/1998 | Lakic | |
| 5,902,660 | A | | 5/1999 | Huang | |
| 5,907,911 | A | | 6/1999 | Huang | |
| 5,916,664 | A | | 6/1999 | Rudy | |
| 5,925,306 | A | | 7/1999 | Huang | |
| 5,937,462 | A | | 8/1999 | Huang | |
| 5,950,332 | A | * | 9/1999 | Lain | 36/29 |
| 5,952,065 | A | | 9/1999 | Mitchell et al. | |
| 5,976,451 | A | | 11/1999 | Skaja et al. | |

5,979,078 A 11/1999 McLaughlin
5,987,780 A 11/1999 Lyden et al.
5,993,585 A 11/1999 Goodwin et al.
6,013,340 A 1/2000 Bonk et al.
6,027,683 A 2/2000 Huang
6,029,962 A 2/2000 Shorten et al.
6,055,746 A 5/2000 Lyden et al.
6,065,150 A 5/2000 Huang
6,085,444 A * 7/2000 Cho ..... 36/3 R
6,098,313 A 8/2000 Skaja
6,119,371 A 9/2000 Goodwin et al.
6,127,010 A 10/2000 Rudy
6,128,837 A 10/2000 Huang
6,176,025 B1 1/2001 Patterson et al.

* cited by examiner

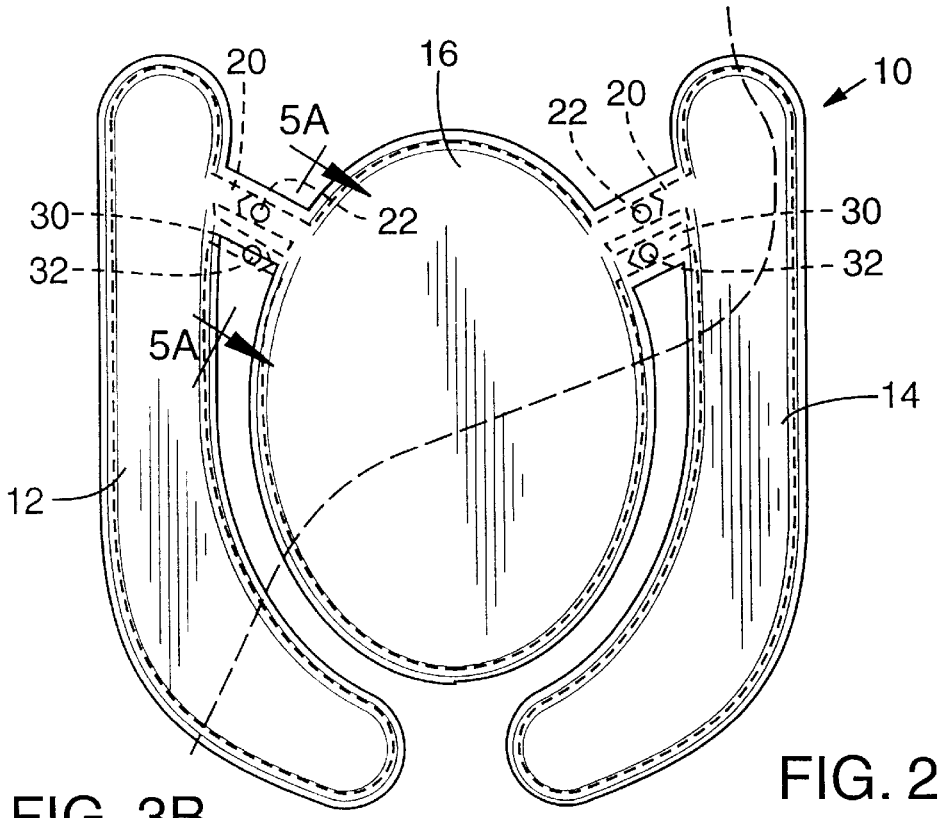
FIG. 3B
FIG. 2B
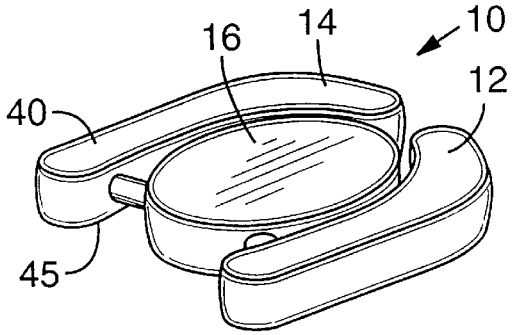
FIG. 5A
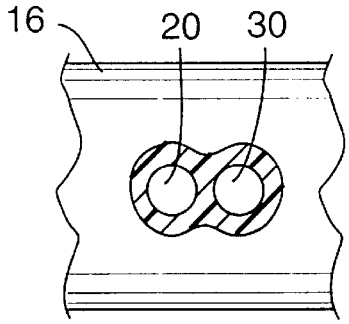
FIG. 4
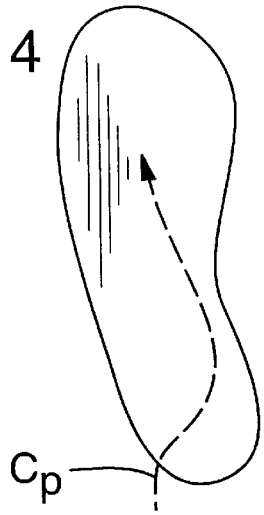
FIG. 5B
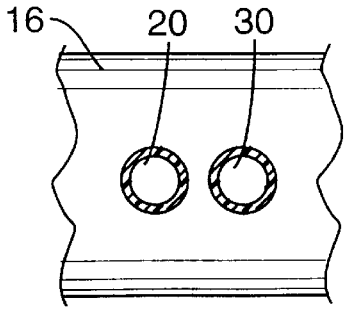

ARTICLE OF FOOTWEAR WITH A MOTION CONTROL DEVICE

FIELD OF THE INVENTION

The invention relates to an article of footwear which has a dynamically changing motion control and cushioning bladder system. The bladder system provides varying amounts of resistance to side-to-side motion depending on the severity of such motion while walking, running, or participating in other athletic activities.

BACKGROUND OF THE INVENTION

The typical running stride involves the runner landing on the lateral, posterior edge of the footwear in the heel region followed by pronation toward the medial side as the foot continues through its stride. As footstrike continues, the foot stops pronating and begins to supinate as the foot rocks forward so that the foot reaches a neutral position at midstance. From midstance, the foot rocks forward to the forefoot region where toe-off occurs at the ball and front of the foot. Toe-off typically involves the toes on the medial side of the foot pushing off the running surface as the foot leaves the ground to begin a new cycle.

Pronation involves the rolling of the foot from its lateral, posterior side to its inner, medial side. Although pronation is normal and necessary to achieve proper foot positioning, it can be a source of foot and leg injuries for runners who over pronate. The typical runner who over pronates lands on the outer, lateral side of the heel in a supinated position and then rolls medially across the heel toward the inner side of the footwear beyond a point which may be considered normal. While some amount of pronation is helpful in decreasing pressure and stress experienced by the leg, excessive pronation can cause stress on various joints, bones and soft tissue. Supinating, which involves rolling of the foot from the medial to the lateral side, while not as common as over pronating, can also cause foot and leg injuries if it is excessive.

Modern running and walking footwear are a combination of many elements each having a specific function which aids in the overall ability of the footwear to withstand many miles of running or walking, while providing cushioning and support for the foot and leg. Articles of athletic footwear are divided into two general parts, an upper and a sole. The upper is designed to snugly and comfortably enclose the foot, while the sole must provide traction, protection and a durable wear surface. It is often desirable to provide the footwear with a midsole having a layer of resilient, cushioning materials for enhanced protection and shock absorption when the heel strikes the ground during the stride of the wearer. This is particularly true for training or jogging footwear designed to be used over long distances or over a long period of time. These cushioning materials, must be soft enough to absorb the shock created by the foot strike and firm enough not to "bottom out" before the impact of the heel strike is totally absorbed.

Attempts have also been made to provide support and comfort in an article footwear by incorporating bladders in fluid communication with each other within a sole. Examples of these devices include U.S. Pat. No. 4,183,156 to Rudy (which is hereby incorporated by reference); U.S. Pat. No. 4,446,634 to Johnson et al.; U.S. Pat. No. 4,999,932 to Grim; Austrian Patent No. 200,963 to Schutz et al.; and HYDROFLOW®ST, by BROOKS® Sports, Inc.

Conventional running and walking footwear designed to provide the user with the maximum amount of available cushioning tend to sacrifice footwear stability by using a midsole cushioning system that is too soft and has too much lateral flexibility for a person who over pronates or requires some form of motion control. The lateral flexibility and deformation of traditional cushioning materials contribute to the instability of the subtalar joint of the ankle and increase the runner's tendency to over pronate. This instability has been cited as one of the causes of "runners knee" and other such athletic injuries. As a result, over-pronators generally do not use contemporary shoes specifically designed for maximum cushioning, but instead use heavier, firmer footwear, or footwear having motion control devices specifically designed to correct physical problems such as excessive pronation. Motion control devices limit the amount and/or rate of subtalar joint pronation immediately following foot strike.

Various ways of resisting excessive pronation or instability of the subtalar joint have been proposed and incorporated into running footwear as motion control devices. In general, these devices have been fashioned by modifying conventional footwear components, such as the heel counter, and/or the midsole cushioning materials. Unlike the present invention, current motion control devices do not repeatedly adjust their level of support to match the varying degree of side-to-side motion accompanying each foot strike. Instead, when used to control pronation, devices such as firm medial posts limit over pronation by providing a substantially rigid structure with a constant stiffness and level of support that presses against the medial side of the foot, limiting internal rotation of the ankle. Examples of motion control devices include: U.S. Pat. No. 5,046,267, to Kilgore et al.; U.S. Pat. No. 5,155,927, to Bates et al.; and U.S. Pat. No. 5,367,791, to Gross et al.

SUMMARY OF THE INVENTION

Two of the most common reasons for foot and knee injuries sustained by runners and walkers are insufficient shock absorption and a lack of proper lateral motion control. Both reasons must be considered when designing footwear so the wearer receives the proper amount of cushioning and motion control without significantly increasing the overall weight of the footwear. Many runners who require a moderate amount of motion control may have to use heavy, bulky footwear, which is weighted down by support features, and designed for the severe over pronator.

The present invention introduces cushioning and dynamic motion control in a single, multi-bladder system providing optimum cushioning, while simultaneously providing the needed amount of motion control by stiffening a portion of the footwear in response to the individual user's lateral motion, most frequently pronatory motion. The bladder system of the present invention takes into consideration the center-of-pressure pathway of the foot during typical footstrike to increase medial stiffness in response to lateral-to-medial rotation of the foot, so the more a user pronates, the stiffer the medial portion of the footwear is made. The bladder system provides comfort and control without the extra weight and bulk of prior art support structures because the support is provided by the flow of fluid in the cushioning system. The bladder system also provides a dynamically changing cushioning system that functions when pressure is applied to its region of the footwear and returns to equilibrium when the pressure is removed.

The present invention utilizes lightweight bladders for the dual purposes of cushioning and motion control. As a result, motion control footwear incorporating the present invention can be made lighter than its contemporary counterparts and provides a level of support commensurate with the degree of lateral motion, such as over-pronation, in each stride of the user.

An article of footwear for controlling side-to-side motion of a foot of a wearer according to the present invention comprises an upper, a sole attached to the upper, and a bladder system positioned within the sole of the footwear. The system includes at least first and second bladder chambers positioned side-by-side of one another and in fluid communication. A first valve is positioned between the first bladder chamber and the second bladder chamber. The first valve opens at a first predetermined level of pressure so that a fluid contained within the first outer bladder chamber is forced into the second bladder chamber when pressure within the first bladder chamber reaches the predetermined level to increase the pressure in the second bladder chamber and dynamically increase the support provided by the second bladder chamber on the side it is disposed.

In one preferred embodiment, the bladder system positioned is within a heel region of the sole and the first bladder chamber is disposed adjacent one side of the heel region, a third bladder chamber is disposed adjacent the other side of the heel region and the second bladder chamber is disposed between the first and third bladder chambers in fluid communication therewith. A second valve is positioned between the third bladder chamber and the second bladder chamber. The second valve includes a second pressure regulator that prevents fluid flow from the second bladder to the third bladder chamber when the pressure in the second bladder chamber is below a second predetermined pressure and allows fluid flow from the second bladder chamber to the third bladder chamber when the pressure in the second bladder chamber is at or above the second predetermined pressure to increase the pressure in the third bladder chamber and dynamically increase the support provided by the third bladder chamber.

The present invention also includes an embodiment which forces fluid from a central chamber into two outer chambers which surround it to stabilize the foot and prevent medial and lateral turning of the foot. In this embodiment, valves positioned within conduits connecting the chambers allow the contained fluid to immediately flow from the central chamber into the outer chambers when pressure is applied to the central chamber. In this embodiment, the direction of immediate fluid flow between the central chamber and the first outer chamber is opposite to that discussed above with respect to the other embodiments of the present invention. In this embodiment, fluid immediately flows from the central bladder to the two outer bladders when pressure is applied. Fluid only flows from the first outer bladder to the central bladder when it slowly bleeds back into it during the rest phase of the running or walking stride.

BRIEF DESCRIPTION OF THE DRAWINGS

FIG. 2B is a perspective view of the bladder system according to the present invention;

FIG. 3B is a top view of the bladder system according to the present invention having two conduit lines extending between the bladder chambers;

FIG. 4 illustrates a typical path of the center of pressure of the foot during a stride.

FIGS. 5A and 5B are cross-sectional views, with valves removed, taken generally along lines 5A—5A and 5B—5B of FIGS. 3A and 3B to illustrate different embodiments of the conduits according to the present invention.

DETAILED DESCRIPTION OF THE PREFERRED EMBODIMENTS

Figure 1:
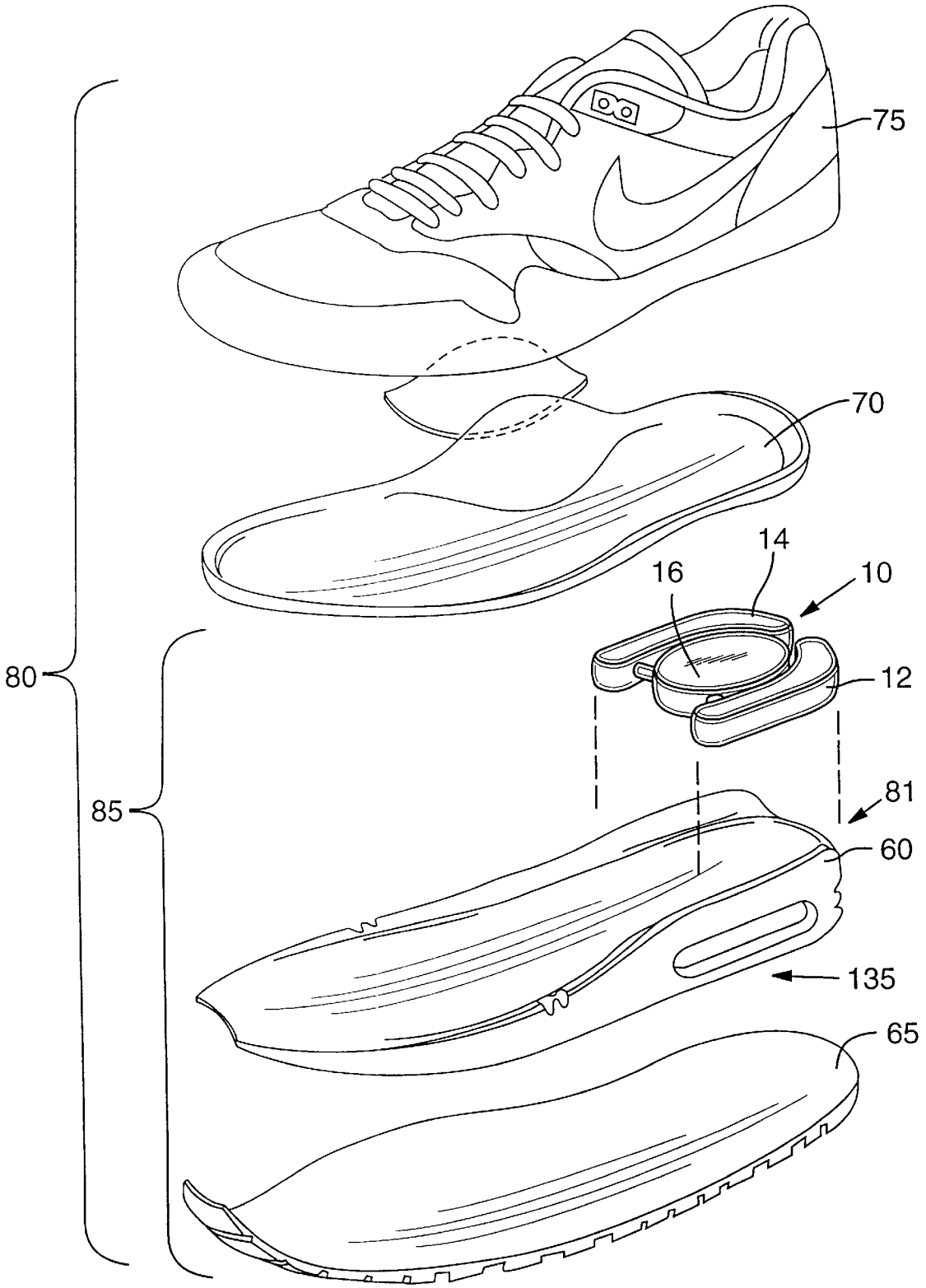
FIG. 1 is an exploded view of an article of footwear incorporating a bladder system according to the present invention.

An article of athletic footwear 80 including a dynamic, cushioning and motion control bladder system 10 according to the present invention is shown in FIG. 1. Footwear 80 is comprised of an upper 75 for covering a wearer's foot and a sole assembly 85. Bladder system 10 is incorporated into a midsole layer 60. An outsole layer 65, for engaging the ground, is secured to at least a portion of midsole layer 60 to form sole assembly 85. A sock liner 70 is preferably placed in shoe upper 75. Depending upon the midsole material and performance demands of the shoe, midsole layer 60 can also form part or all of the ground engaging surface so that part or all of outsole layer 65 can be omitted. Bladder system 10 is located in the heel region 81 of footwear 80 and is incorporated therein by any conventional technique such as foam encapsulation or placement in a cut-out portion of a foam midsole. A suitable foam encapsulation technique is disclosed in U.S. Pat. No. 4,219,945 to Rudy, hereby incorporated by reference.

Figure 2A:
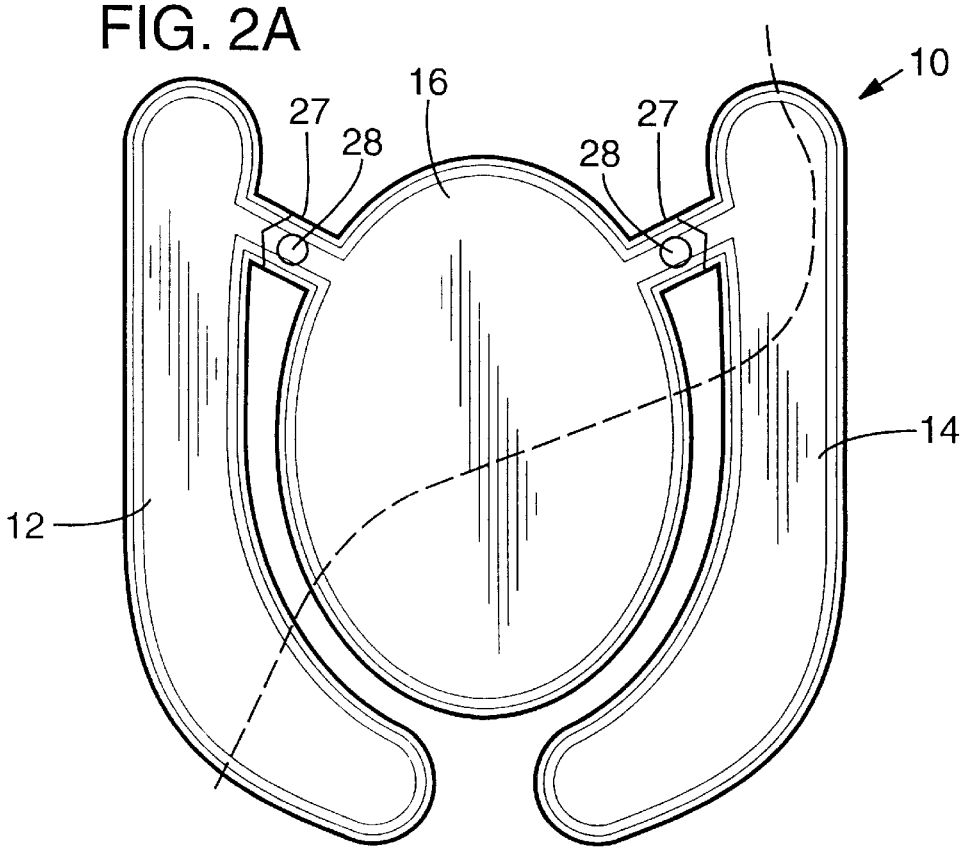
FIG. 2A is a top view of the bladder system according to the present invention having a single conduit housing between the bladder chambers.

As illustrated in FIGS. 1 and 2A, bladder 12 includes outer, lateral bladder chamber 12 and outer, medial bladder chamber 14. A central bladder chamber 16 is positioned between and in fluid communication with lateral and medial bladder chambers 12, 14 so that bladders 12, 14, and 16 are arranged in a side-by-side relationship. Lateral bladder chamber 12 and central bladder chamber 16 are fluidly connected by a first conduit 20. A second conduit 30 fluidly connects central bladder chamber 16 and medial bladder chamber 14. In the embodiment illustrated in FIG. 2A, chambers 12, 14, and 16 are fluidly connected by conduits 27.

Figure 3A:
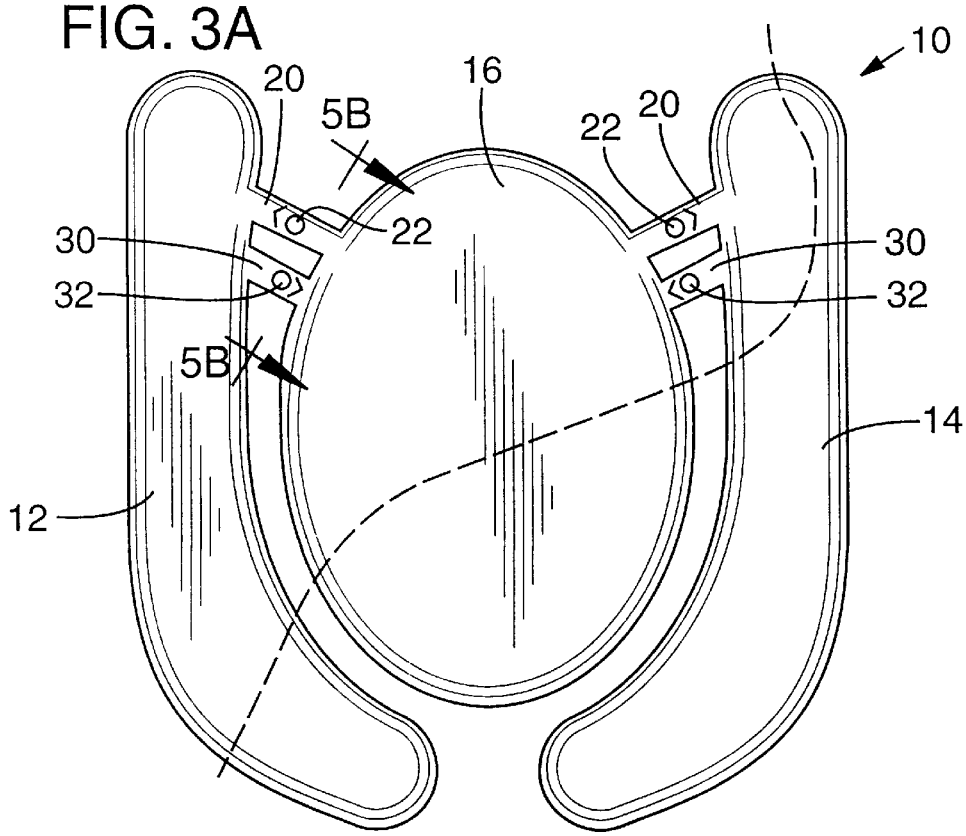
FIG. 3A is a top view of the bladder system according to the present invention having a single housing with two conduit lines extending between the bladder chambers.

Bladder chambers 12, 14, 16 and conduits 27 of FIG. 2A, or conduits 20, 30 of FIGS. 3A and 3B, are formed of a thermoplastic elastomeric barrier film, such as polyester polyurethane, polyether polyurethane, such as a cast or extruded ester based polyurethane film having a shore "A" hardness of 80–95, e.g., Tetra Plastics TPW-250. Other suitable materials can be used such as those disclosed in the '156 patent to Rudy. Among the numerous thermoplastic urethanes which are particularly useful in forming the film layers are urethanes such as Pellethane™, (a trademarked product of the Dow Chemical Company of Midland, Mich.), Elastollan® (a registered trademark of the BASF Corporation) and ESTANE® (a registered trademark of the B. F. Goodrich Co.), all of which are either ester or ether based and have proven to be particularly useful. Thermoplastic urethanes based on polyesters, polyethers, polycaprolactone and polycarbonate macrogels can also be employed. Further suitable materials could include thermoplastic films containing crystalline material, such as disclosed in U.S. Pat. Nos. 4,936,029 and 5,042,176 to Rudy, which are incorporated by reference; polyurethane including a polyester polyol, such as disclosed in U.S. Pat. No.

6,013,340 to Bonk et al., which is incorporated by reference; or multi-layer film formed of at least one elastomeric thermoplastic material layer and a barrier material layer formed of a copolymer of ethylene and vinyl alcohol, such as disclosed in U.S. Pat. No. 5,952,065 to Mitchell et al., which is incorporated by reference.

In a preferred embodiment of the present invention, bladder chambers 12, 14, 16 and conduits 27, 20, 30 are integrally formed of first and second sheets 40, 45 of elastomeric barrier film. In a preferred embodiment of the present invention, bladders 12, 14, 16 are formed from generally transparent or translucent elastomeric film to enable visibility through the bladders.

U.S. Pat. Nos. 4,183,156 ('156) and 4,219,945 ('945) to Marion F. Rudy, the contents of which are hereby expressly incorporated by reference, describe conventional welding techniques which can be used to form the shapes of the bladder chambers 12, 14, 16 and conduits 20, 30. As disclosed in the '156 and '945 patents, sheet 40 and 45 can be welded to one another to define the side walls of bladder chambers 12, 14, 16 and conduits 20, 30, as well as interior welds (not shown in the drawings) within the bladder chambers to maintain the bladder chambers in a generally flat configuration.

In an alternative embodiment of the present invention bladder chambers 12, 14, 16 and conduits 27, 20, 30 are formed using conventional blow-molding techniques.

Bladder chambers 12, 14, 16 can be sealed to hold air or other fluid at ambient pressure, or can be pressurized with an appropriate fluid, for example, hexafluorethane, sulfur hexafluoroide, nitrogen, air, or other gases such as those disclosed in the aforementioned '156, '945, '029, or '176 patents to Rudy, or the '065 patent to Mitchell et al. If pressurized, the fluid or gas can be placed in the bladder through an inflation tube (not shown) in a conventional manner by means of a needle or hollow welding tool. After inflation, the bladder can be sealed at the juncture of the bladder and inflation tube, or by the hollow welding tool around the inflation point on the inflation tube.

FIG. 4 diagrammatically illustrates the path $C_p$ of the center of pressure that a foot applies during typical running. As seen therein, the center of pressure is initially applied at the rear lateral edge of the foot at footstrike and moves diagonally medially and forward. The medial motion of the center of pressure is indicative of the natural pronation motion that the foot undergoes immediately after footstrike. As the foot rolls forward past the heel area, the pronation motion stops and the foot begins a degree of supination motion in the opposite direction, i.e., from the medial side to the lateral side.

As the center of pressure of the foot during a foot strike moves medially across footwear 80, the pressure within the bladders serially increases in the direction of the pronatory motion until the medial chamber fills and stiffens the medial side of the footwear to prevent excessive pronation, pronation beyond the point which may be considered normal. A pressure gradient created in the bladders during a foot strike, works in conjunction with the pronatory motion of the foot to provide a dynamic level of motion control commensurate with the degree of overpronation.

In order to accomplish this dynamic control, as shown in FIG. 3A, the pressure between the bladder chambers is controlled by first and second flow valves 22, 32 located within first and second conduits 20, 30, respectively. Valves 22, 32 include one-way valves such as Vernay duck-bill valves or flapper valves. Valves 22, 32 can also include those discussed in U.S. Pat. No. 5,253,435 to Auger et al. and U.S. Pat. No. 5,257,470 to Auger et al., both hereby expressly incorporated by reference. One way or check valves which limit fluid flow to only one direction and which are commonly found in medical devices such as syringes and bulb pumps can also be used. Conduit 20 and valve 22 freely deliver fluid in the direction of the foot stride. Conduit 30 and valve 32 allow the displaced fluid to slowly return to its original chamber. Valves 22, 32 are positioned at the forward end of bladder system 10 in order to protect them from impact during a foot strike. Conduits 20, 30 can either be two separate members each having its own fluid line as shown in FIG. 5B, or as shown in FIG. 5A, one member including two fluid lines.

As shown in FIG. 2A, a single, one-way valve 28 with a slow return bleed can be substituted for valves 22 and 32. A single valve 28 is located within a single conduit 27 extending between two adjacent bladders. As with valves 22 and 32, each single valve and each single conduit would be in fluid communication with the forward end of a pair of adjacent bladders.

Valves 22 or single, one-way valve 28 can open instantaneously when pressure rises within chamber 12 or 16 as a result of a foot strike to allow fluid to pass into chamber 16 or 14, respectively. The time the regulating members within these valves may remain open is between 1 and 5 milliseconds. One preferred opening time is about 5 milliseconds. The regulating members included, for example, the flaps on a flapper valve. These valves may also be set to open for fluid flow in the direction of the stride when the differential pressure between the bladders reaches a predetermined level, for example, from any minimal differential up to a 10 psi or greater differential. Other well known pressures levels may also be used to trigger these valves. The triggering pressure levels will vary depending upon the initial cushioning pressures established in the bladders when they are inflated. Setting the valves to open at a preset pressure differential allows the bladder chambers and fluid flow to be customized for severe pronators, larger runners or other users who require specific or additional amounts of cushioning from a bladder.

Prior to the heel of a user touching down, the predetermined pressure in the bladder chambers preferably is equal: $P_L=P_C=P_M$. The range of pressure within the bladders is preferably between 15 and 30 psi, with the preferred pressure being 20 psi. Initial striking of the heel increases the pressure $P_L$ within lateral bladder chamber 12 by deforming it. As the foot strike continues and $P_L$ exceeds $P_C$ or the value for which flow valve 22 is calibrated, valve 22 opens and fluid flows through conduit 20 from lateral bladder chamber 12 to central chamber 16 causing a pressure rise in central chamber 16 which results in $P_C>P_M$. The pressure in central bladder chamber 16 rises even further with the pronating motion because the center-of-pressure moves medially to compress center bladder chamber 16. As $P_C$ exceeds $P_M$ or the calibrated differential limit for valve 22, between chambers 14 and 16, valve 22 opens and fluid from central bladder chamber 16 flows into medial bladder chamber 14. The resulting increased pressure in chamber 14 stiffens the medial side of heel region 81 to prevent any further medial rolling of the foot i.e., limit pronation. The increased pressure in medial bladder chamber 14 and stiffness of the medial side of footwear 80 is dependent on the location and force of the heel strike.

Bladder system 10 adapts to the amount of pronation during a stride and stiffens the medial side of footwear 80 accordingly. The serial increase of pressure from lateral bladder chamber 12 to central bladder chamber 16 to medial bladder chamber 14 can be referred to as pressure ramping. The degree of lateral to medial motion and the location of the foot strike dictate the resulting pressure in medial bladder chamber 14 and the resulting degree of stiffness along the medial side of footwear 80. Pressure ramping within system 10 is greatest when the user lands on the outer, lateral edge of the footwear and the resulting foot motion is largely in the lateral to medial direction. As previously discussed, this type of pronatory foot motion initially applies pressure to lateral bladder chamber 12, forcing its fluid into central bladder chamber 16. As the foot stride continues, pressure is applied to central bladder chamber 16 and a volume of fluid in the central chamber is forced into medial bladder chamber 14, thereby stiffening the medial side of footwear 80.

A user who does not over pronate generally will put less initial pressure on the lateral side of the footwear and will force less fluid, if any, into bladders 16 and 14 during a typical stride when compared to an over pronator having the same striking force. When a person who does not pronate uses footwear 80, the resulting stiffness along the medial side differs from that discussed above, assuming that both heel strikes are equal in force. For example, if the heel strike of a user first compresses only central bladder chamber 16 and the pressure in lateral chamber 12 remains below the release limit of valve 22 in conduit 20, only fluid from central bladder 16 will be available to transfer to medial bladder chamber 14. The resulting pressure in chamber 14 will therefore be only the sum of the fluid pressure in chamber 14 and the amount transferred from chamber 16. Flow valve 22 positioned between chambers 12 and 16 will prevent fluid from leaving lateral bladder chamber 12 until the pressure in chamber 12 is greater than the pressure at which valve 22 opens. Valve 32 maintains the pressure in chamber 12 at its initial level, either by preventing fluid from flowing into chamber 12 or by working in conjunction with valve 22 so that the amount of fluid that enters chamber 12 through valve 32 will exit through valve 22 into chamber 16. Hence, the pressure in medial bladder 14 will not rise to the aggregate pressure achieved during a more pronatory heel strike, i.e. one that begins by striking the lateral portion of the footwear, because the available fluid in bladder 16 will not be an aggregate of that from bladders 12, 14 and 16. Instead, it will only effectively include fluid from chambers 14 and 16. Accordingly, the less a runner pronates, the less the medial side of the shoe stiffens.

After the landing phase of running is over, equilibrium or initial pressure between the bladders is re-established before the next heel strike, either by a slow leak through the single two-way valve 28, or through valve 32, which allows fluid to pass back into the central and lateral bladder chambers. The typical recovery time for returning these bladder chambers to rest pressure is between 0.1 and 2 seconds with the most preferred time being approximately 1 second. As discussed above, the recovery time will depend on the amount of the fluid forced from each bladder chamber. The smaller the chambers or the less fluid transferred, the shorter the recovery time for the system.

Figure 6:
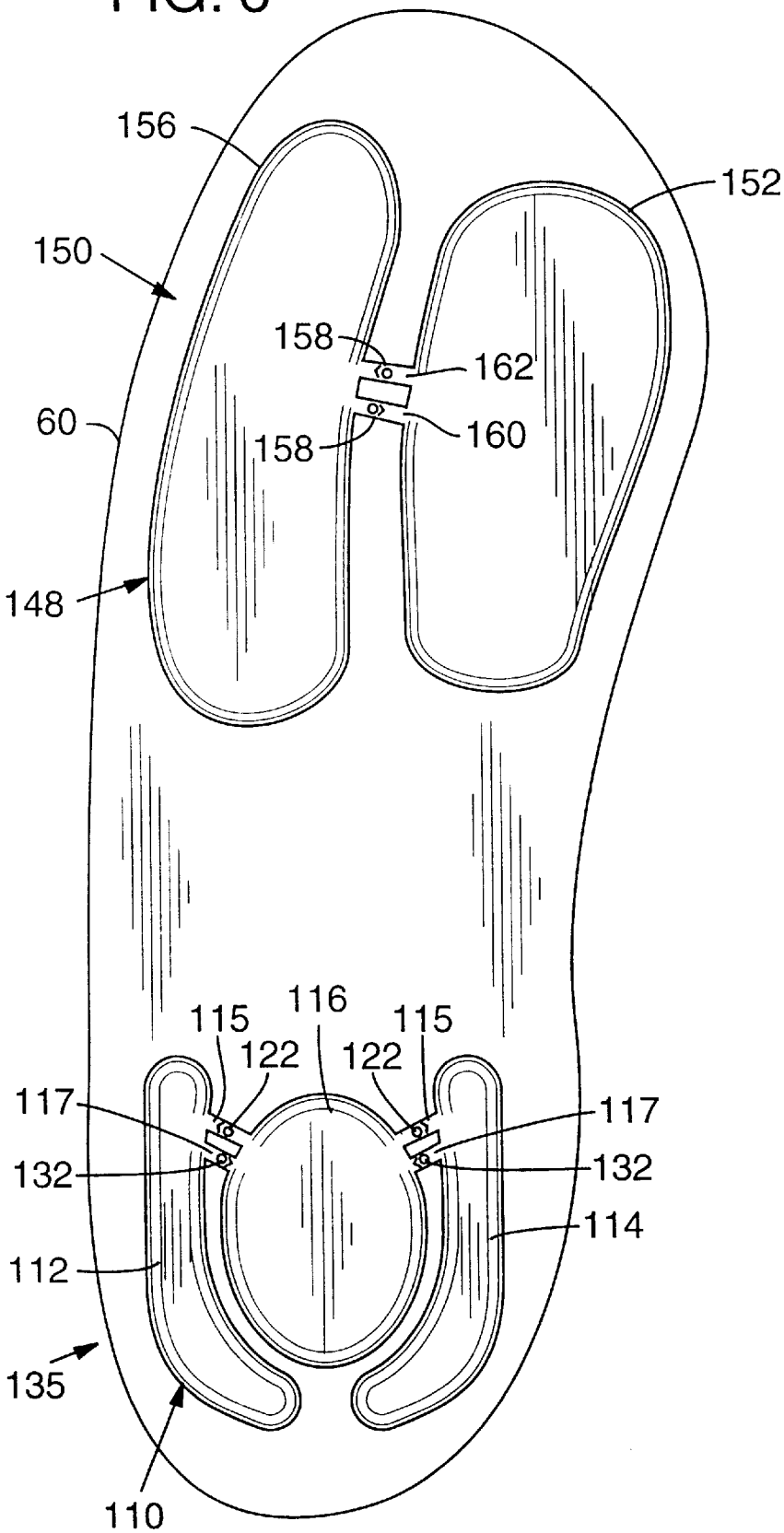
FIG. 6 is a top view of another embodiment of the bladder system according to the present invention.

As seen in FIG. 6, a cushioning system 100, can extend along the length of footwear 80, i.e., with bladder chambers in the heel region and the forefoot region. Cushioning system 100 includes a bladder system 110. Bladder system 110 is constructed the same as bladder system 10, with similar components in FIG. 6 labeled with like numbers as bladder system 10, but in the 100 series of numbers. Bladder chambers 112, 114 and 116 function in the same way as bladder chambers 12, 14 and 16, respectively, to stiffen the medial side of footwear 80 behind the instep in the heel region 135.

Cushioning system 100 also includes a bladder system 148 formed of bladder chambers 152 and 156 in the forefoot region 150 to provide lateral stability and increased performance when running or jumping. Bladder chambers 152 and 156 extend along the forefoot region of footwear 80 and are formed of the same material as bladder chambers 12, 14 and 16. Bladder chambers 152 and 156 include a supportive, cushioning fluid which can be the same as that used in the rear bladder chambers 112, 114 and 116 or a different fluid, as discussed above. Bladder chambers 152 and 156 are in fluid communication with each other by a pair of conduits 158, each having a valve 160, 162. Valves 160, 162 are the same as valves 122, 132, respectively, except that they may be designed to function at different pressure levels or differentials than bladder 122, 132. In contrast to valve 122, discussed above, valve 160 allows fluid flow in the medial to lateral direction in order to stiffen the lateral side of the forefoot of footwear 80 during a foot stride. As the foot strike moves through the forefoot of footwear 80, fluid flows out of medial chamber 152 into lateral chamber 156 to stiffen the lateral side of footwear 80. The pressure ramping in the forefoot follows the same principles as that in the heel region, except that fluid flows in the opposite direction. Pressure ramping in the forefoot stiffens the lateral side of footwear 80 to support to the foot when cutting or turning for increased performance, or to support the forefoot during the propulsion phase of running or walking. As bladder chamber 156 fills with the fluid from chamber 152, it creates a wedge effect within the forefoot that the user can push against when turning, jumping, or running. Valve 162 allows for the return of fluid from chamber 152 to chamber 156.

The pressure ramping system can be divided into any number of chambers. Its effectiveness is determined by relative volumes, locations and the number of chambers used to provide the pressure ramping function. The number of chambers used is at least in part based on the pressure in the plantar region as a function of time for any give defined movement. The positioning and size of the bladders depends on the type of footwear they are incorporated into and the activity in which they will be used. For example, a system located within an article of footwear intended to be used for basketball may be have a different size, a different at rest pressure and different valve triggering pressures than footwear used for running. Also, the basketball footwear may incorporate the forefoot portion of cushioning system 100 where as such a system may not be needed within running footwear.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

I claim:

1. An article of footwear for controlling side-to-side rotational motion of a foot of a wearer, said article of footwear comprising:

an upper for receiving the foot;

a sole attached to said upper, said sole having a lateral side and a medial side;

at least a first bladder chamber and a second bladder chamber located side-by-side in said sole; and a valve system for placing said first bladder chamber and said second bladder chamber in two-directional fluid communication, said valve system including a first valve structured to transfer a fluid from said first bladder chamber to said second bladder chamber only when a difference in pressure between said first bladder chamber and said second bladder chamber exceeds a first predetermined pressure differential, said valve system thereby operating to transfer said fluid to one of said sides in response to a compression of said sole, and said valve system thereby providing increased medial or lateral support, to respectively limit pronation or supination of the foot.

2. The article of footwear of claim 1, wherein said first bladder chamber is located in said lateral side of said sole and said second bladder chamber is located in said medial side of said sole, said valve system thereby increasing medial support and limiting pronation in response to said compression of said sole.

3. The article of footwear of claim 2, wherein said bladder chambers are located in a heel portion of said footwear.

4. The article of footwear of claim 1, wherein said first bladder chamber is located in said medial side of said sole and said second bladder chamber is located in said lateral side of said sole, said valve system thereby increasing lateral support and limiting supination in response to said compression of said sole.

5. The article of footwear of claim 4, wherein said bladder chambers are located in a forefoot portion of said sole.

6. The article of footwear of claim 1, wherein said first valve is two-directional and structured to return said fluid from said second bladder chamber to said first bladder chamber following said compression of said sole.

7. The article of footwear of claim 6, wherein said valve system includes a conduit that joins said first bladder chamber with said second bladder chamber, said first valve being located in said conduit.

8. The article of footwear of claim 1, wherein said first valve is one-directional, said valve system including a one-directional second valve structured to return said fluid from said second bladder chamber to said first bladder chamber following said compression of said sole.

9. The article of footwear of claim 8, wherein said valve system includes a first conduit and a second conduit that join said first bladder chamber with said second bladder chamber, said first valve being located in said first conduit, said second valve being located in said second conduit.

10. An article of footwear for controlling side-to-side rotational motion of a foot of a wearer, said article of footwear comprising:

an upper for receiving the foot, a sole attached to said upper;

at least a first bladder chamber, a second bladder chamber, and a third bladder chamber located in said sole, said first bladder chamber being located in a lateral portion of said sole, said third bladder chamber being located in a medial portion of said sole, and said second bladder chamber being located between said first bladder chamber and said third bladder chamber; and a valve system including:

a first lateral valve for placing said first bladder chamber and said second bladder chamber in fluid communication, said first lateral valve being structured to transfer a fluid from said first bladder chamber to said second bladder chamber only when a difference in pressure between said first bladder chamber and said second bladder chamber exceeds a first predetermined pressure differential, thereby decreasing a fluid pressure in said first bladder chamber and increasing a fluid pressure in said second bladder chamber, and a first medial valve for placing said second bladder chamber and said third bladder chamber in fluid communication, said first medial valve being structured to transfer said fluid from said second bladder chamber to said third bladder chamber only when a difference in pressure between said second bladder chamber and said third bladder chamber exceeds a second predetermined pressure differential, thereby decreasing a fluid pressure in said second bladder chamber and increasing a fluid pressure in said third bladder chamber, said valve system thereby operating to serially direct said fluid in a lateral-to-medial direction by transferring said fluid from said first bladder chamber to said second bladder chamber and thereafter to said third bladder chamber in response to a compression of said sole, and said valve system thereby providing increased medial support for regulating pronation of the foot.

11. The article of footwear of claim 10, wherein said first lateral valve is two-directional and structured to return said fluid from said second bladder chamber to said first bladder chamber following said compression of said sole.

12. The article of footwear of claim 10, wherein said first medial valve is two-directional and structured to return said fluid from said third bladder chamber to said second bladder chamber following said compression of said sole.

13. The article of footwear of claim 10, wherein said first lateral valve is one-directional and said valve system includes a one-directional second lateral valve structured to return said fluid from said second bladder chamber to said first bladder chamber following said compression of said sole.

14. The article of footwear of claim 10, wherein said first medial valve is one-directional and said valve system includes a one-directional second medial valve structured to return said fluid from said third bladder chamber to said second bladder chamber following said compression of said sole.

15. The article of footwear of claim 10, wherein said bladder chambers are located in a heel portion of said footwear.

16. An article of footwear for controlling side-to-side rotational motion of a foot of a wearer, said article of footwear comprising:

an upper for receiving the foot, a sole attached to said upper;

a plurality of bladder chambers located within a heel portion of said sole and serially arranged in a lateral-to-medial direction;

a fluid located within said bladder chambers; and a plurality of valves that place said bladder chambers in fluid communication and transfer said fluid between said bladder chambers, at least a first of said valves being structured to transfer said fluid in said lateral-to-medial direction only when a predetermined pressure differential across said first of said valves is exceeded, said valves operating to serially direct said fluid between said bladder chambers in said lateral-to-medial direction in response to a compression of said sole, thereby providing increased media support for regulating pronation of the foot, said bladder chambers and said valves forming a sealed bladder system wherein said fluid is substantially prevented from exiting said bladder system and an external fluid is substantially prevented from entering said system.

17. The article of footwear of claim 16, wherein said first of said valves places a first bladder chamber and a second bladder chamber in fluid communication, said first bladder chamber being laterally located relative to said second bladder chamber, said first of said valves being two-directional and structured to return said fluid from said second bladder chamber to said first bladder chamber when a pressure in said second bladder chamber exceeds a pressure in said first bladder chamber.

18. The article of footwear of claim 16, wherein said first of said valves places a first bladder chamber and a second bladder chamber in fluid communication, said first bladder chamber being laterally located relative to said second bladder chamber, said first of said valves being one-directional.

19. The article of footwear of claim 18, wherein a second of said valves also places said first bladder chamber and said second bladder chamber in fluid communication, said second of said valves being one-directional and structured to return said fluid from said second bladder chamber to said first bladder chamber when a pressure in said second bladder chamber exceeds a pressure in said first bladder chamber.

* * * * *